US007322485B2

(12) United States Patent
Bradford et al.

(10) Patent No.: US 7,322,485 B2
(45) Date of Patent: Jan. 29, 2008

(54) POUCH ASSEMBLY FOR USE IN A CONTAINER

(75) Inventors: Judson A. Bradford, Holland, MI (US); Donald J. Bazany, Grand Haven, MI (US)

(73) Assignee: Bradford Company, Holland, MI (US)

( * ) Notice: Subject to any disclaimer, the term of this patent is extended or adjusted under 35 U.S.C. 154(b) by 343 days.

(21) Appl. No.: 11/018,298

(22) Filed: Dec. 21, 2004

(65) Prior Publication Data

US 2006/0131312 A1 Jun. 22, 2006

(51) Int. Cl.
*B65D 1/24* (2006.01)
*B65D 25/04* (2006.01)
*B65D 1/36* (2006.01)

(52) U.S. Cl. ..... 220/507; 220/535; 220/529

(58) Field of Classification Search ..... 220/507, 220/535, 529; 206/298
See application file for complete search history.

(56) References Cited

U.S. PATENT DOCUMENTS 1,712,168 A 5/1929 Rand, Jr.
3,980,196 A 9/1976 Paulyson et al.
4,505,512 A 3/1985 Schmeichel et al.
4,527,694 A 7/1985 Bolt et al.
4,852,598 A * 8/1989 Griesenbeck ..... 135/137
4,960,211 A * 10/1990 Bailey ..... 211/60.1
5,086,934 A * 2/1992 Kelly ..... 211/45
5,447,242 A * 9/1995 Kelly et al. ..... 211/42
5,725,119 A 3/1998 Bradford et al.
5,813,566 A * 9/1998 Bradford et al. ..... 220/653
5,815,903 A * 10/1998 Foster et al. ..... 29/401.1
6,062,410 A 5/2000 Bradford et al.
6,230,916 B1 5/2001 Bradford et al.
6,648,142 B1 11/2003 Hugenholtz et al.

* cited by examiner

*Primary Examiner*—Anthony D. Stashick
*Assistant Examiner*—Shawn M. Braden
(74) *Attorney, Agent, or Firm*—Wood, Herron & Evans, LLP

(57) ABSTRACT

A pouch assembly is provided for use in a shipping container. The pouch assembly comprises dunnage in the form of a plurality of pouches for storing and transporting parts. The pouch assembly includes two end panels located inside the container and flexible support rods extending between the end panels for supporting individual pouches. The pouch assembly provides vertical access to product residing inside the pouches or cells inside the container.

3 Claims, 5 Drawing Sheets

POUCH ASSEMBLY FOR USE IN A CONTAINER

FIELD OF THE INVENTION

This invention relates generally to dunnage for use in shipping containers, and more particularly, to a pouch assembly for use in a shipping container.

BACKGROUND OF THE INVENTION

A large number of different container structures are utilized by manufacturers to ship a variety of different products to end users, which may be, for example, assembly plants. In the automobile industry for example, an assembly plant assembling a particular automobile might utilize a number of different parts from different manufacturers. These manufacturers ship their respective parts to the assembly plant in container structures where the parts are then removed from dunnage inside the container structure and assembled into a finished automobile.

In certain applications, the weight of the dunnage in the containers is of particular concern. The lighter the combined container and associated dunnage inside the container, the less costly it is to ship the container, either full of product or empty. Additionally, the lighter the combination container and associated dunnage, the easier it is for a worker to lift and/or move the container from one location to another, i.e. from the back of a truck to a desired location in an assembly plant.

Dunnage inside a container may assume numerous forms depending upon the desired application. One form of dunnage for use in containers is a pouch supported by support members extending from one side of the container to the other. U.S. Pat. Nos. 5,725,119; 6,062,410 and 6,230,916 all disclose such pouches supported by wire cables. Such pouches allow vertical access to the interior of the pouches. Each pouch or cell may store one or more products for storage and/or shipment. The pouches prevent the products from contacting each other and/or harming each other during shipment.

Prior to the present invention, when pouches were used as dunnage in a wide container the support rods supporting the pouches had to have sufficient rigidity to span the width of the container and be strong enough to support the pouch and product(s) inside the pouch without collapsing. This necessitated that the support rods be made of a rigid, heavy material, such as steel, for example. If the support rods were not sufficiently rigid, the pouch would collapse when product was placed therein. Consequently, such rigid support rods added significant weight to the container, increasing the cost of shipment of the container, whether or not the pouches were filled with products. It also made moving containers filled with such dunnage cumbersome.

Accordingly, there is a need for a pouch assembly for use in a container having pouches supported by lightweight rods rigid enough to support the weight of the fabric pouch and the product therein.

SUMMARY OF THE INVENTION

The present invention is directed to a pouch assembly for use in a container and/or box. The container allows access to product inside the container from the top of the container.

The pouch assembly comprises a pair of end panels preferably sized to fit snugly in the container. Each of the end panels has inner and outer walls, each of the walls having a series of holes therein. Although the end panels are preferably made of plastic, they may be made of any type of material.

Flexible support rods extend through the holes of the end panels and span approximately the width of the container. More specifically, each support rod passes through two holes in each end panel. The frictional interaction between the support rod and the end panels prevents the support rod from accidently becoming disengaged from the end panels when product is inserted and/or removed from pouches inside the container. The location of the holes in the end panel may enable one or more of the flexible support rods to be bowed upwardly or downwardly, if desired.

The flexible support rods support dunnage in the form of pouches. The pouches may be made of any desired material. One material which has proven suitable is a textile fabric such as nylon or polyester. The textile material may be coated with a plastic coating such as polyvinylchloride (PVC), for example.

Each pouch is preferably supported by two support rods extending through pockets formed in opposed sides of the pouch. In one embodiment, opposed sides of the pouch comprise separate pieces of material and/or fabric secured together using sewing, welding or any other suitable method. In another embodiment, the pouches are formed of one piece of fabric having multiple pockets formed therein to receive and retain the support rods.

The flexible support rods are made of a lightweight material such as fiberglass or graphite. Although flexible, the support rods are rigid enough to support the weight of the pouch and product even when spanning relatively long distances, i.e. from end panel to end panel.

One advantage of the present invention is that product may be either inserted or removed from dunnage inside a container without dislodging the support rods supporting the dunnage.

Another advantage of the present invention is that the pouches may be supported with rods which are of a lesser weight than those heretofore used to support dunnage of significant length.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
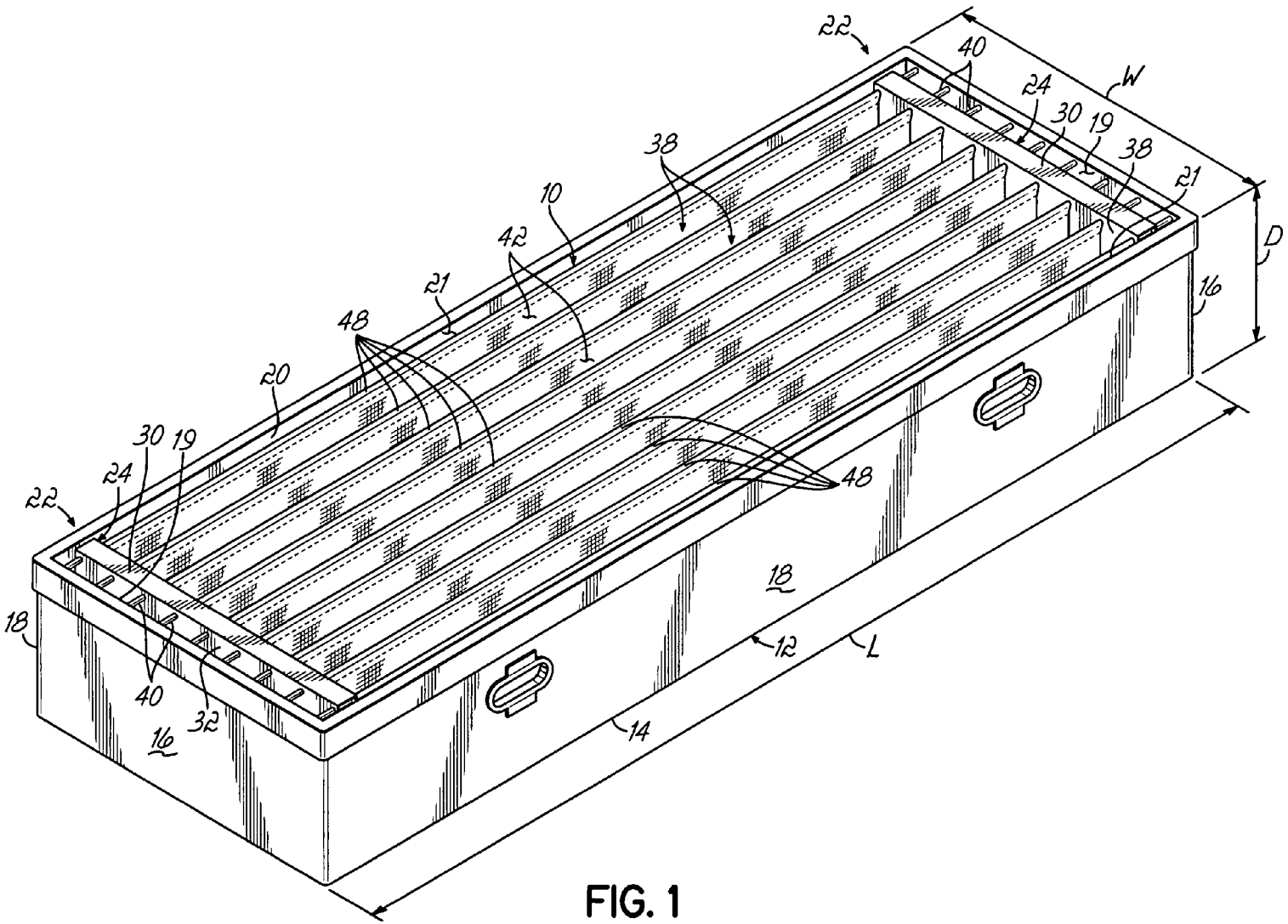
FIG. 1 is a perspective view of a pouch assembly and container according to one preferred embodiment of the present invention.
Figure 2:
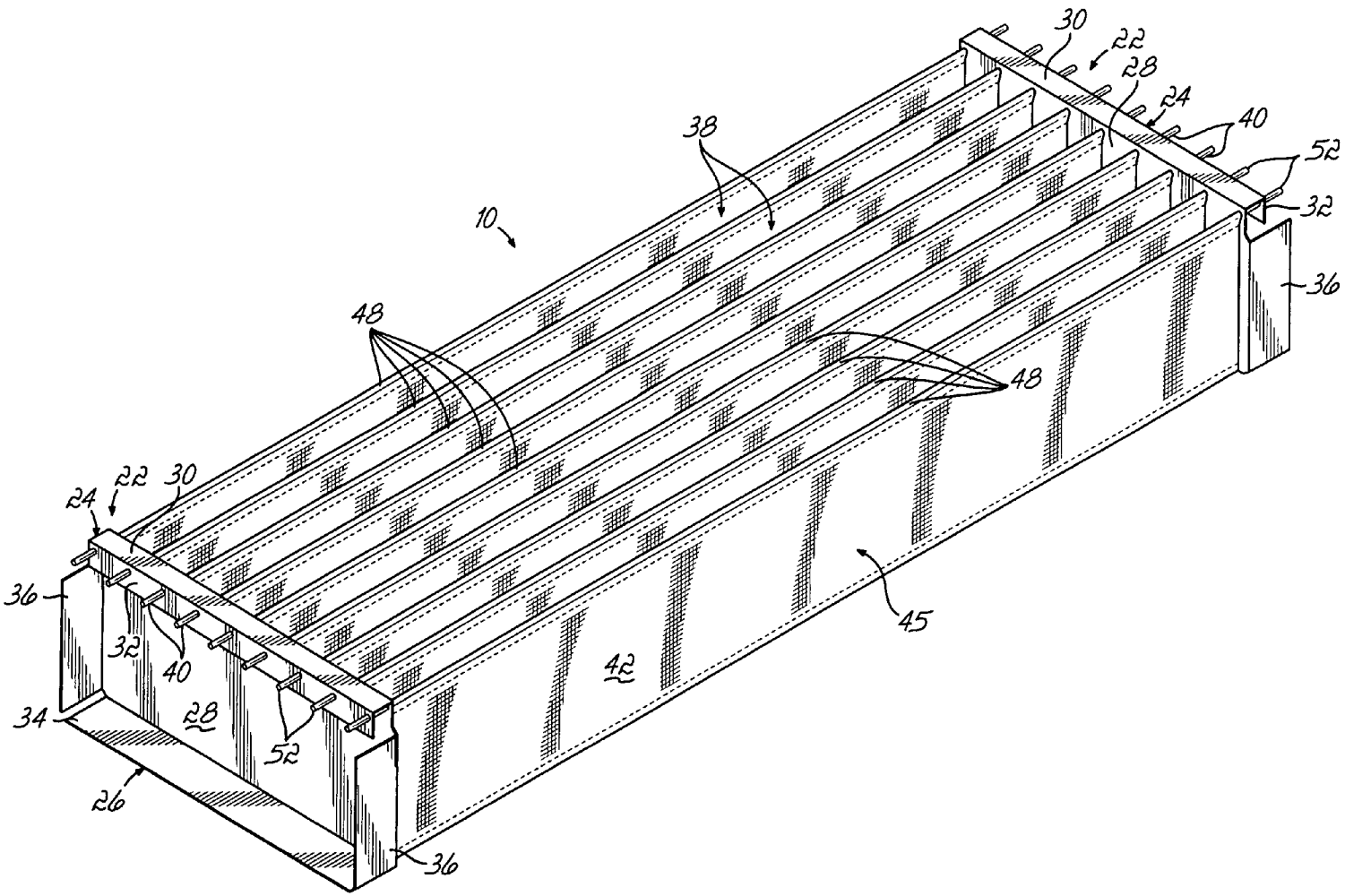
FIG. 2 is a perspective view of the pouch assembly of FIG. 1.

Referring to the drawings and particularly to FIG. 2, there is illustrated a pouch assembly 10 according to one preferred embodiment of the present invention. The pouch assembly 10 is illustrated in a container 12 in FIG. 1 and outside the container 12 in FIG. 2. Referring to FIG. 1, the generally rectangular container 12 has a bottom 14, a pair of end walls 16 and a pair of side walls 18, the end and side walls 16, 18 extending upwardly from the bottom 14 of the container. The bottom 14, end walls 16 and side walls 18 define an interior 20 of the container 12. See FIG. 1. The distance "L" between the inner surfaces 19 of the end walls 16 defines the length of the interior 20 of the container 12. Similarly, the distance "W" between the inner surfaces 21 of the side walls 18 defines the width of the interior 20 of the container 12. The height of the end walls 16 and side walls 18 defines the depth "D" of the container 12. Although one type of container 12 is illustrated and described, the present invention may be used in any type of container.

Figure 3:
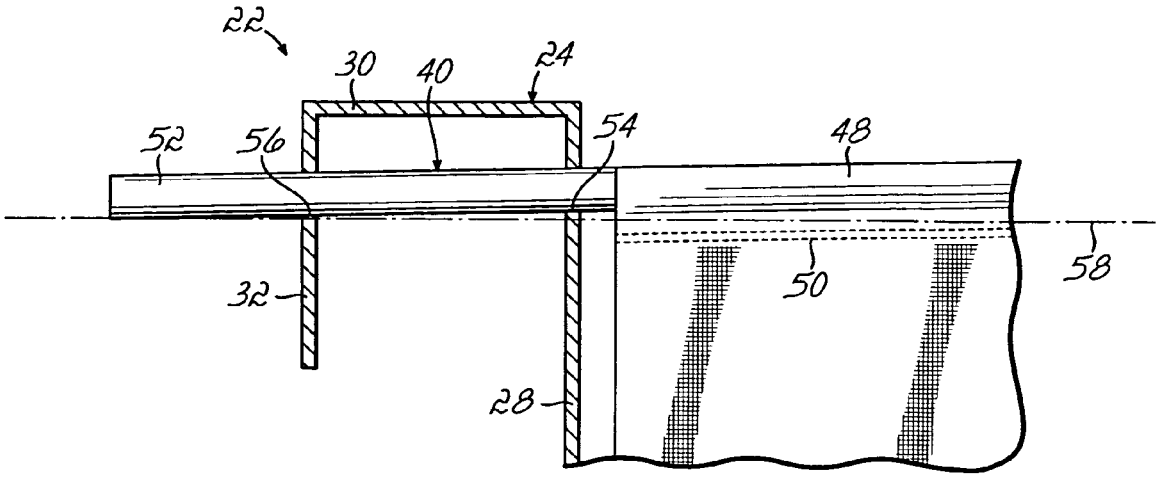
FIG. 3 is a side elevational view of a portion of the pouch assembly of FIG. 1.

As best illustrated in FIG. 2, the pouch assembly 10 comprises a pair of end panels 22. The end panels 22 are identical to each other but face opposite directions. Each end panel 22 has an upper portion 24 shown in detail in FIG. 3 and a lower portion 26 as shown in FIG. 2. The upper and lower portions 24, 26 of the end panel 22 share a common inner wall 28. As best illustrated in FIG. 3, the upper portion 24 of the end panel 22 further comprises a horizontally oriented top wall 30 and an outer wall 32 which is vertically oriented and generally parallel the inner wall 28 of the end panel 22. The lower portion 26 of the end panel 22 has a bottom flange 34 and two opposed side flanges 36 extending outwardly from the inner wall 28 of the end panel 22. As shown in FIG. 1, the end panels 22 are preferably sized to fit inside the interior 20 of the container 12 snugly, but may be any desired size. Although one configuration of end panel 22 is illustrated and described, other configurations or types of end panels 22 may be used in accordance with the present invention.

Figure 4:
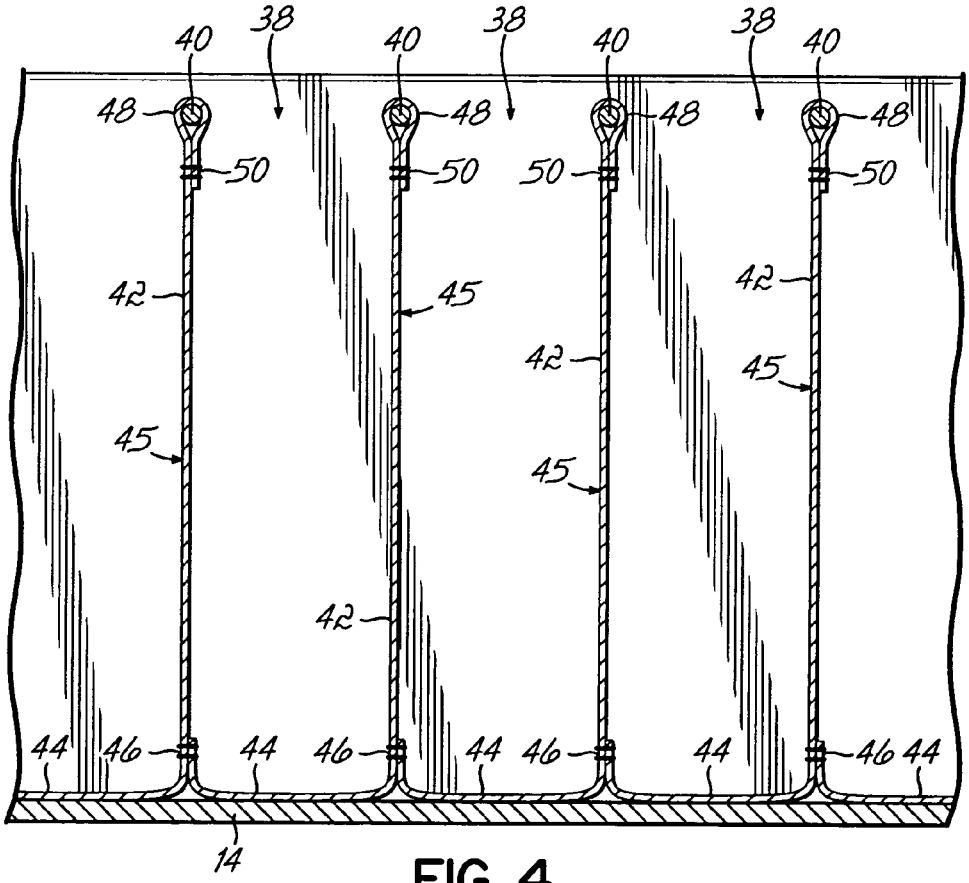
FIG. 4 is a side elevational view of a portion of the pouch assembly of FIG. 1.

As best illustrated in FIG. 2, the pouch assembly 10 further comprises a plurality of pouches 38 which are supported by support rods 40. As best illustrated in FIG. 4, each pouch 38 has a generally U-shaped configuration including opposed sides 42 and a bottom 44. Although the bottom 44 of each pouch 38 is illustrated contacting the bottom 14 of the container 12, the bottom 44 of the pouch 38 may be raised off the bottom 14 of the container 12.

As shown in FIG. 4, according to one preferred embodiment of the present invention, each pouch 38 is formed by joining together multiple J-shaped pieces of material 45 at junctures 46. These junctures 46 may be stitches, welds or any other securing devices. At the top of each J-shaped piece of material 45 is a pocket 48 adapted to receive and retain one of the support rods 40. The pocket 48 is preferably formed by doubling over the material and securing it to itself at securement 50. See FIG. 4. However, the support rods 40 may be secured to the tops of the J-shaped pieces of material 45 in any other known manner.

As illustrated in FIGS. 1 and 2, each of the support rods 40 extends through one of the pockets 48 formed in one of the sides 42 of one of the pouches 38. Consequently, the weight of each pouch 38 and its contents are supported by two support rods 40 extending from one end panel 22 to the other end panel.

As illustrated in FIG. 2, each support rod 40 has a pair of opposed end portions 52 which project outwardly beyond the pocket 48 through which the support rod 40 passes. As illustrated in FIG. 3, each end portion 52 of a support rod 40 passes through a hole 54 formed in the inner wall 28 of an end panel 22 and through a hole 56 formed in the outer wall 32 of the same end panel 22.

The holes 54, 56 in an end panel 22 may be located so as to orient the support rod 40 passing therethrough in a desired orientation. For example, the holes 54, 56 shown in FIG. 3 are located so as to impart an upwardly directed bow or arch to the support rod 40. As seen in FIG. 3, the hole 54 through the inner wall 28 of the end panel 22 is located slightly above the hole 56 through the outer wall 32 of the end panel 22. In such an orientation, when one or more products (not shown) are placed in the pouch 38 supported by arched or bowed support rods 40, the combined weight of the pouch 38 and product (not shown) may move the support rods 40 to a horizontal position or orientation shown by the horizontal line 58 shown in FIG. 3. However, due in part to the bow or arch imparted to the support rods 40 by the location of the holes 54, 56 in the end panels 22, the combined weight of the pouch 38 and product (not shown) will not collapse the support rods 40 and/or the pouch 38, even using lightweight, flexible support rods 40.

Thus, one advantage of the pouch assembly 10 of the present invention is that the support rods 40 may be made of a lighter weight material than heretofore possible due, at least in part, to the interaction between the end panels 22 and the support rods 40. Another advantage of the pouch assembly 10 of the present invention is that the support rods 40 may be made of a flexible material due, at least in part, to the interaction between the end panels 22 and the support rods 40.

In alternative embodiments, the holes 54, 56 in the end panels 22 may be located to orient the support rods 40 in a horizontal orientation without such an upwardly directed bow or arch. In certain application, such orientation may be desirable prior to loading products in the pouches 38.

Figure 4A:
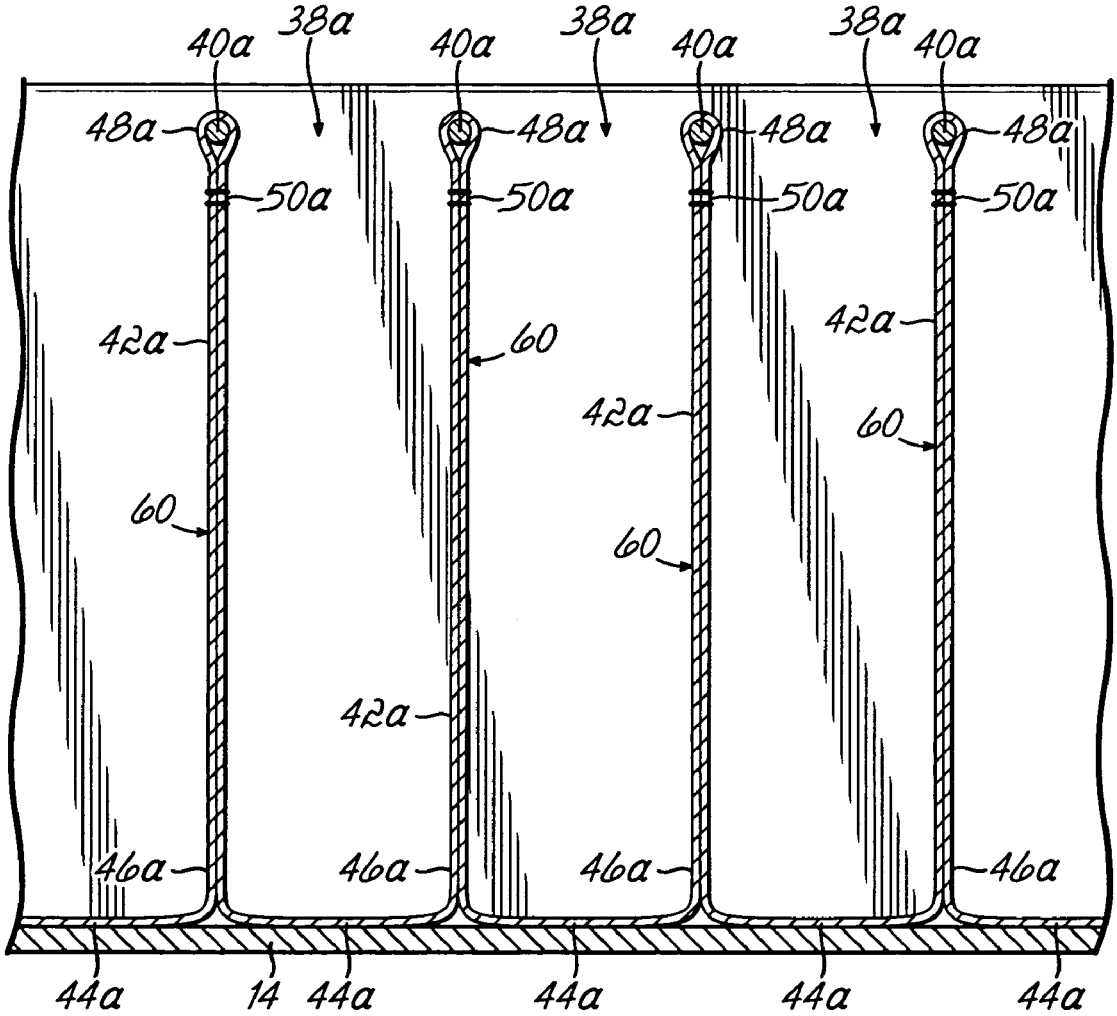
FIG. 4A is a side elevational view of a portion of an alternative embodiment of pouch assembly.

In an alternative embodiment shown in FIG. 4A, the pouches 38*a* are not created by joining together individual pieces of fabric, but instead are formed from one relatively long piece of fabric 60 folded around support rods 40*a*. The piece of fabric 60 is secured together with securements 50*a* to create pockets 48*a*, through which the support rods 40*a* pass or extend. In this embodiment, each side 42*a* of each pouch 38*a* has a double ply thickness and each pouch 38*a* has a bottom 44*a*. Depending upon the application, this double-ply feature may be desirable.

Figure 5:
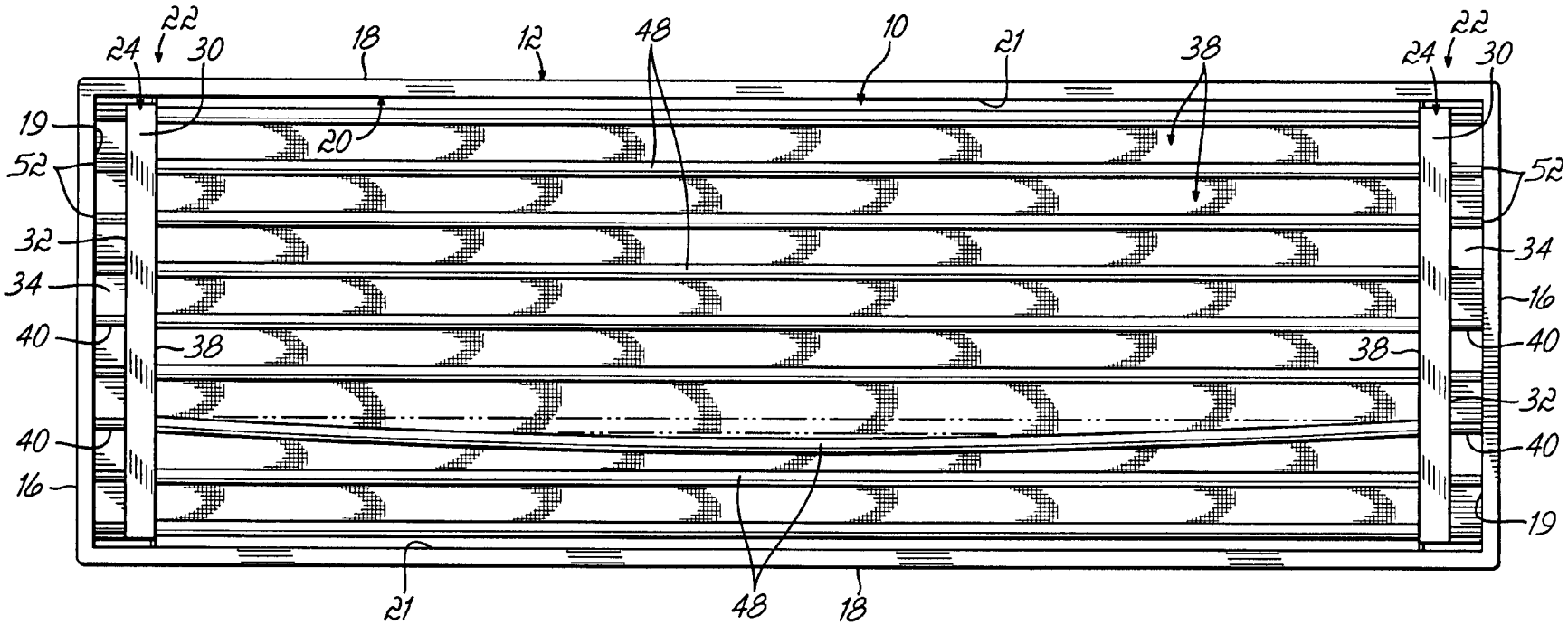
FIG. 5 is a top plan view of the pouch assembly and container of FIG. 1.

As shown in FIG. 5, one of the support rods 40 may flex forwardly into a flexed position as shown in solid lines from a relaxed position shown in dashed lines without one or both of the end portions 52 of the support rod 40 becoming dislodged from one or both of the end panels 22. The double walled engagement of the support rod 40 with each end panel 22 makes it difficult for the support rod to disengage from one or both end panels 22 due to the frictional engagement therebetween. When a user is removing one or more products from a pouch 38, it may happen that the user accidently moves one or more support rods 40 to a flexed position as shown in FIG. 5.

While we have described several preferred embodiments of the present invention, persons skilled in the art will appreciate changes and modifications which may be made without departing from the spirit of the invention. For example, although one configuration of dunnage is illustrated and described, the present invention may be used with other configurations of dunnage. Therefore, we intend to be limited only by the scope of the following claims and equivalents thereof:

We claim:

1. In combination, a container and a pouch assembly for use in the container, said combination comprising:

a container;

a pouch assembly comprising a pair of end panels, each of the end panels being sized to fit inside an interior of the container and having an inner wall and an outer wall shorter than said inner wall, each of said walls having a plurality of holes therethrough;

a plurality of flexible support members extending between the end panels, each of the support rods passing through at least two aligned holes in each of the end panels, one of said aligned holes being in said inner wall and the other of said aligned holes being in said outer wall; and dunnage hanging from the support members.

2. The combination of claim 1 wherein the dunnage comprises pouches.

3. The combination of claim 1 wherein the pouches are secured together.

* * * * *